US006260599B1

(12) United States Patent
You

(10) Patent No.: US 6,260,599 B1
(45) Date of Patent: Jul. 17, 2001

(54) CORRECTION TAPE ROLLER DEVICE

(76) Inventor: Kwang-Ho You, 103-1102 Hyundae Apartment, 1037 Mansu-dong, Namdong-ku, Inchun-shi, Kyonggi-do (KR)

( * ) Notice: Subject to any disclaimer, the term of this patent is extended or adjusted under 35 U.S.C. 154(b) by 0 days.

(21) Appl. No.: 09/330,507

(22) Filed: Jun. 11, 1999

(51) Int. Cl.[7] ..... B32B 31/00
(52) U.S. Cl. ..... 156/577; 156/579
(58) Field of Search ..... 156/238, 523, 156/527, 540, 574, 577, 579; 225/46; 118/76, 200, 257; 242/160.2, 160.4, 170, 171, 588, 588.2, 588.3, 588.6

(56) References Cited

U.S. PATENT DOCUMENTS 5,490,898 2/1996 Koyama et al. .
5,556,469 9/1996 Koyama et al. .
5,759,270 * 6/1998 Lee ..... 156/577 X
5,785,437 * 7/1998 Koyoma et al. ..... 156/540 X
5,792,263 8/1998 Koyama et al. .

* cited by examiner

*Primary Examiner*—Mark A. Osele
(74) *Attorney, Agent, or Firm*—Anderson, Kill & Olick P.C.

(57) ABSTRACT

A correction tape roller device for covering an incorrect typography on paper with an adhesive correction material. The correction material roller device includes a first cog wheel for rotating a first roller, a second cog wheel for rotating according to a rotational degree of the first cog wheel, such that the tape from which the correction material has been peeled off is wound around the first roller, and a third cog wheel rotatably installed on one side of the inner surface of the case while being engaged with the first cog wheel. The third cog wheel is provided with a protrusion guiding the tape passing through the tape guide to control the tape tension so that the tape does not become loose.

2 Claims, 7 Drawing Sheets

CORRECTION TAPE ROLLER DEVICE

BACKGROUND OF THE INVENTION

1. Field of the Invention

The present invention relates to a correction tape roller device, and more particularly, to a correction tape roller device for covering an incorrect typography on paper with an adhesive correction material by pressing the tape coated with the correction material over the typographical errors on paper, and correcting the portion covered with the adhesive correction material in the necessary form.

2. Description of the Prior Art

A general correction tape roller device includes a predeterminately shaped case having an opening, at least one pair of rollers which are rotatably installed in the case, a tape wound on the rollers, and a tape guide which is installed in the opening, for guiding movement of the tape and allowing the correction material-coated tape to be pressed on paper.

A conventional correction tape roller device will be described with reference to FIGS. 1 and 2, in connection with the above correction tape roller device.

FIG. 1 is an exploded perspective view showing one example of a conventional correction tape roller device. FIG. 2 is an exploded perspective view showing the internal structure of the correction tape roller device of FIG.

Referring to FIG. 1, a correction tape roller device 100 is disclosed in U.S. Pat. No. 5,792,263, which includes a case 110, a first roller 130 around which the tape 120 coated with the correction material is wound, a second roller 140 around which the tape 120 from which the correction material has been peeled is wound, and a tape guide 150 in which at least one side thereof protrudes outward from the case 110 to allow the tape 120 coated with the correction material to be pressed on paper needed to be corrected, for guiding movement of the tape 120. Also, the correction tape roller device 100 further comprises an internal supporter 160 installed in the case 110, for stably supporting the first roller 130, the second roller 140, and the tape guide 150, a first gear 170 for rotating the first roller 130, a second gear 180 rotatably installed while being engaged with the first gear 170, for supporting the second roller 140, and a cap 190 combined with the front end of the case 110.

That is to say, when the tape 120 is pulled in one direction by an operation for coating the correction material on paper at the assembly state, the first roller 130 rotates and thus the second roller 170 rotates. Then, the second gear 180 engaged with the first gear 170 rotates, and the second roller 140 which is combined with the second gear 120 rotates. Naturally, the second roller 140 rotates in the reverse direction to the first roller 130. Thus, the correction tape 120 is released from the first roller 130 and moves along the tape guide 150 to be wound around the second roller 140. In this situation, the correction material is coated on the paper.

When the correction tape 120 moves, the moving path of the correction tape 120 should be properly adjusted so that the correction tape 120 smoothly moves. Such a play is performed by a first guide pole 112 and a second guide pole 114. The first guide pole 112 guides the tape 120 released from the first roller 130 and the second guide pole 114 guides the tape 120 from which the correction material has been peeled off to be wound around the second roller 140. Here, the first guide pole 112 always contacts an inner surface 120*a* of the tape 120, that is, a smooth surface, which does not prevent the tape 120 from proceeding. Meanwhile, the second guide pole 114 does not prevent the tape 120 form moving in a general situation, that is, in the case that the tape 120 is supplied at the state that the correction material has been completely peeled off from the tape 120. However, in the case that the tape 120 is supplied at the state that the correction material has not yet been removed from the tape 120, the tape 120 does not smoothly move due to a relatively large frictional force generated between the correction material and the second guide pole 114. To alleviate the above shortcoming, a guide rod 116 is further fitted on the outer circumferential surface of the second guide pole 114. The guide rod 116 includes a throughhole 117 into which the second guide pole 114 is inserted and a head 118 for preventing the tape 120 from seceding upwards from the guide rod 116.

That is, when the tape 120 is supplied at the state that the correction material has not been completely removed and thus the frictional force between the tape 120 and the guide rod 116 becomes larger, the guide rod 116 rotates to provide an advantage that the tape 120 from which the correction material has not been completely removed is comparatively smoothly passed. However, during correction, when the tape 120 from which the correction material has not been completely removed is instantaneously supplied toward the guide rod 116, it may occur that the guide rod 116 does not rotate. In this situation, the tape 120 is not supplied toward the second roller 140. Thus, the phenomenon that the tape 120 between the guide rod 116 and the end of the tape guide 150 becomes loose occurs often. If the tape guide 150 is kept apart from the paper at the state that the tape 120 between the guide rod 116 and the end of the tape guide 150 becomes loose, the whole tape 120 remaining between the first roller 130 and the second roller 140 becomes loose, and thus the portion where the correction material has been coated may freely move at the end of the tape guide 150. It is difficult to perform a correction work at the state that the tape 120 freely moves. In particular, a correction work of the minute portion cannot be accurately performed. Accordingly, the correction work should be performed after applying a sufficient tension to the tape 120 between the first roller 130 and the second roller 140 by reversely rotating the first roller 130 or the second roller 140 by force by means of a predetermined tool. This is a very cumbersome process. In addition, as being the case, it frequently occurs that the second guide pole 114 is broken during assembly or disassembly, in which case the whole case 120 cannot be used.

SUMMARY OF THE INVENTION

To solve the above problems, it is an object of the present invention to provide a correction tape roller device in which tape is smoothly supplied and taken up between a first roller and a second roller, to thereby improve inconvenience in use that the tension of the tape should be adjusted during use.

To accomplish the above object of the present invention, there is provided a correction tape roller device having a predeterminately shaped case, a first roller rotatably installed in the case and around which tape coated with a correction material is wound, a second roller, adjacent the first roller, around which the tape released from the first roller and from which the correction material has been peeled off while passing through a predetermined path is wound, a fixing pole installed protrudingly in the inner surface of the case along the tape movement path, for guiding the correction material coated tape to move, and a tape guide installed protrudingly outward from one side of the case, for guiding the tape to move and press the correction material coated tape over predetermined paper to allow the correction material to be peeled off, the correction material roller device comprising: a first cog wheel installed on the lower side of the first roller and rotating according to a release degree of the tape wound around the first roller; a second cog wheel installed on the lower side of the second roller, and rotating according to a rotational degree of the first cog wheel while being engaged with the first cog wheel, with a result that the tape from which the correction material has been peeled off is wound around the first roller; and a third cog wheel rotatably installed in one side of the inner surface of the case while being engaged with the first cog wheel, and rotating according to a rotational degree of the first cog wheel, on the surface of which a pole guiding the tape having passed through the tape guide to move is formed.

There is also provided a correction tape roller device having a predeterminately shaped case, a first roller rotatably installed in the case and around which tape coated with a correction material is wound, a second roller, adjacent the first roller, around which the tape released from the first roller and from which the correction material has been peeled off while passing through a predetermined path is wound, and a tape guide installed protrudingly outwards from one side of the case, for guiding the tape to move and pressing the correction material coated tape over predetermined paper to allow the correction material to be peeled off, the correction material roller device comprising: a first cog wheel installed on the lower side of the first roller and rotating according to a release degree of the tape wound around the first roller; a second cog wheel installed on the lower side of the second roller, and rotating according to a rotational degree of the first cog wheel while being engaged with the first cog wheel, with a result that the tape from which the correction material has been peeled off is wound around the first roller; a third cog wheel rotatably installed in one side of the inner surface of the case while being engaged with the first cog wheel, and rotating according to a rotational degree of the first cog wheel, on the surface of which a pole guiding the tape having passed through the tape guide to move is formed; and a rotational ring rotatably installed on the lower end of the outer circumferential surface in the pole, for guiding the correction material coated tape.

BRIEF DESCRIPTION OF THE DRAWINGS

The object and other advantages of the present invention will become more apparent by describing in detail the structures and operations of the present invention with reference to the accompanying drawings, in which.

DETAILED DESCRIPTION OF THE INVENTION

Preferred embodiments of the present invention will be described in detail with reference to the accompanying drawings.

Figure 1:
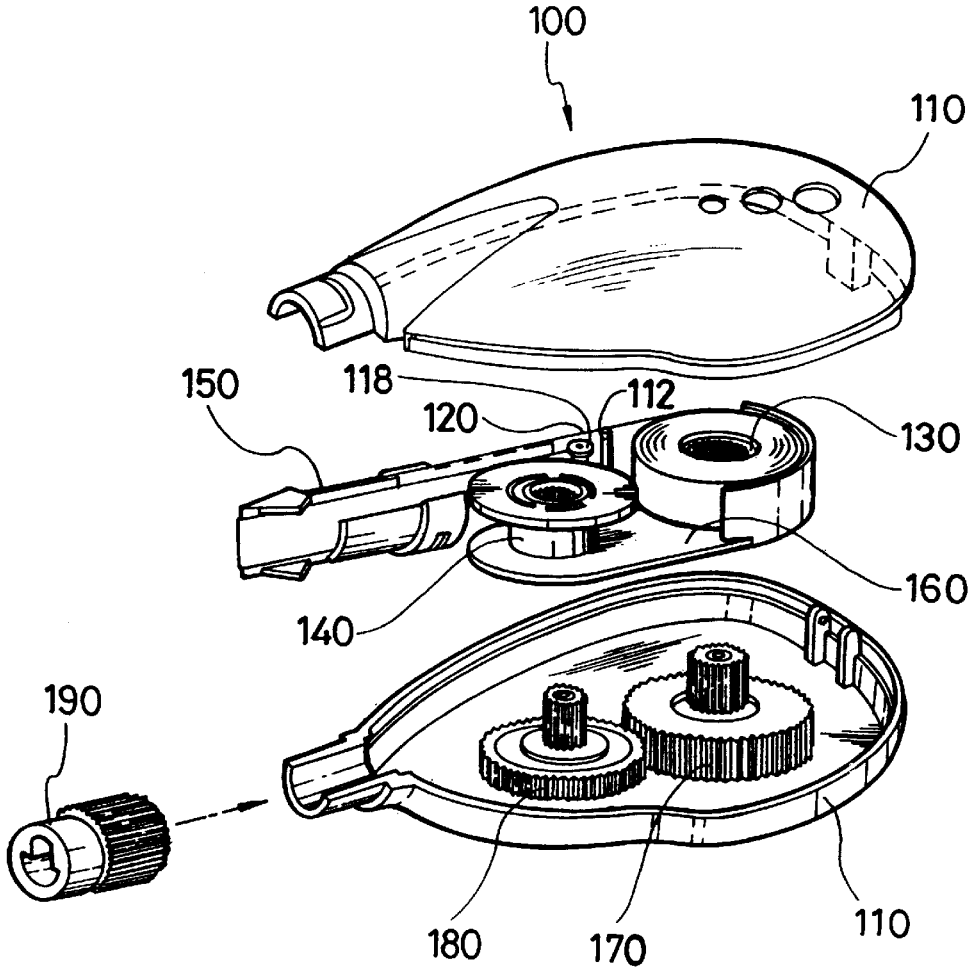
FIG.1 (Prior Art)
FIG. 1 is an exploded perspective view showing a conventional correction tape roller device.
Figure 2:
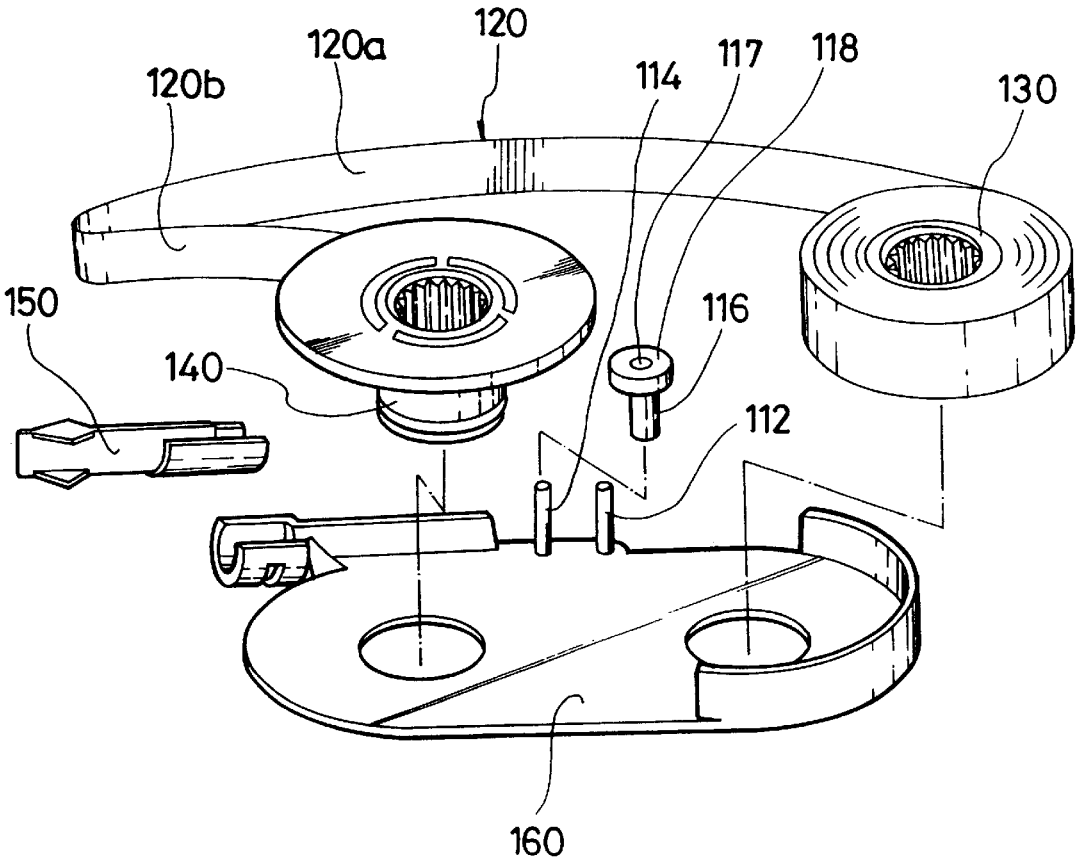
FIG. 2 (Prior Art)
FIG. 2 is an exploded perspective view showing the internal structure of the correction tape roller device of FIG. 1.
Figure 3:
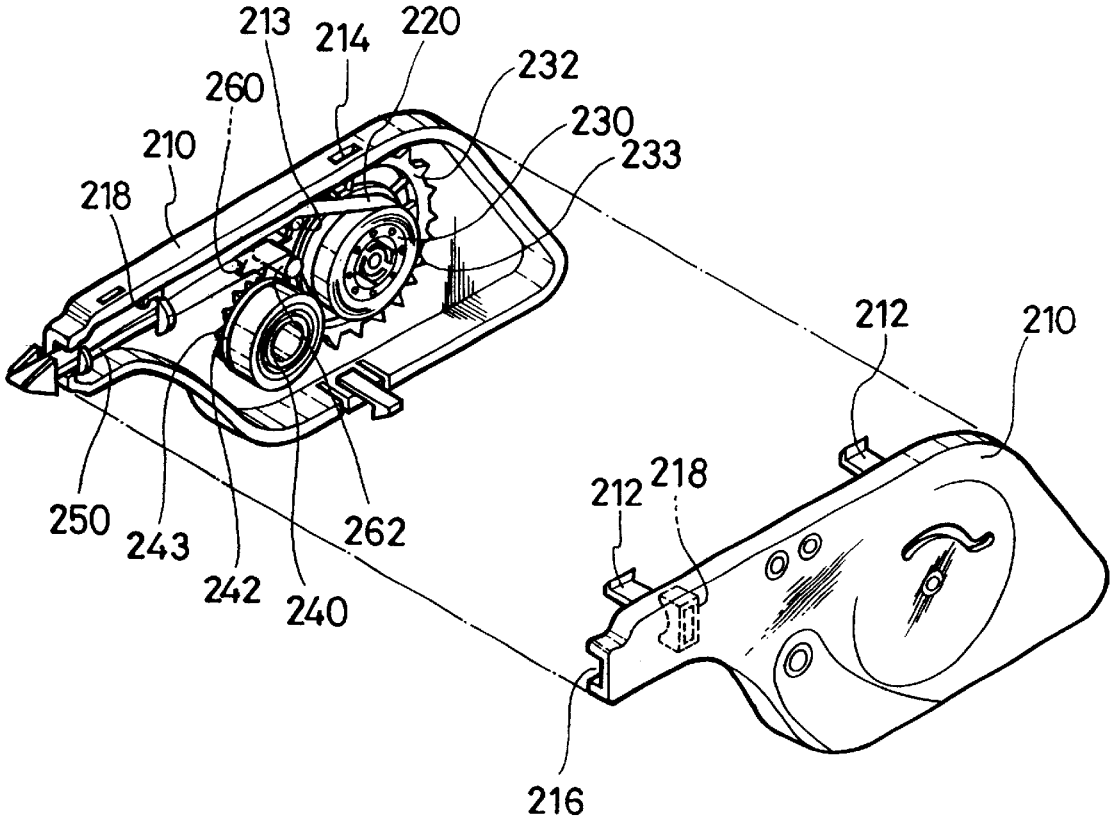
FIG. 3 is an exploded perspective view of a correction tape roller device according to the present invention.
Figure 4:
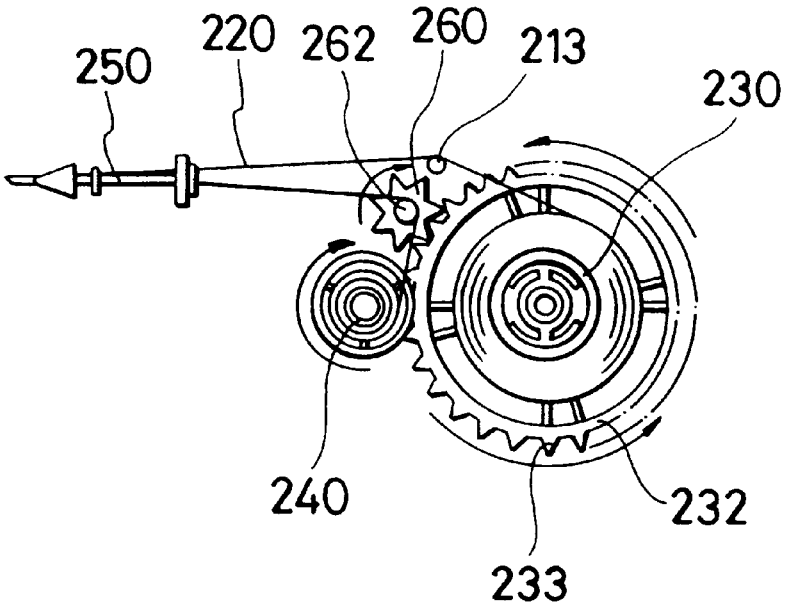
FIG. 4 is a view for explaining the tape movement procedure in the correction tape roller device of FIG. 3.

As shown in FIGS. 3 through 4, a correction tape roller device 200 according to the present invention includes a case 210. The case 210 has the structure where two substantially symmetrical members are combined with each other, and includes a sufficient space for installing internal components therein. Engagement protrusions 212 and latch holes 214 are installed in the respectively corresponding positions of the case 210. It is desirable that the case 210 can be dismantled as necessary. By doing so, the first roller 230 and the second roller 240 around both of which new tape is wound can be replaced after complete consumption of the tape 220.

An opening 216 is formed in one side of the case 210. A tape guide 250 is protrudingly installed via the opening 216. The tape guide 250 guides the tape 220 to move and presses the correction material coated tape 220 over predetermined paper. The tape guide 250 is rotatably installed in its place by a predetermined angle in a guide installation unit 218 formed in the inner surface of the case 210. That is, the tape guide 250 is made to rotate by 90 degrees or so at the state shown in FIG. 3 for the user's convenience, to perform a correction work. In this situation, the user can hold the case 210 comfortably, which can facilitate a correction work. Thus, the internal tape 220 keeps a slightly twisted state between the fixing pole 213 and the tape guide 250, and the protrusion 262 of the third cog wheel 260 and the tape guide 250.

As shown in FIG. 3, the first roller 230 is installed in the case 210. The first roller 230 is rotatably installed in its place, around which the correction material coated tape 220 is wound. The first cog wheel 232 having teeth 233 is installed in the lower end of the first roller 230.

The second roller 240 is installed adjacent the first roller 230. The second roller 240 is also rotatably installed in its place. The second cog wheel 242 having teeth 243 rotating while being engaged with the first cog wheel 232 is installed in the lower end of the second roller 240.

Here, the first roller 230 and the second roller 240 are engaged with each other by means of the teeth 233 and 243. The rotational ratio between the first roller 230 and the second roller 240 is constant. However, the diameter of the tape 220 wound around each roller is varied according to the use of the tape. To prevent any problem from occurring due to the variation in diameter of the tape wound, the diameter of the first roller 230 and the second roller 240 should be adjusted, considering the thickness of the correction material coated tape 220 wound around the first roller 230 and the tape 220 wound around the second roller 240 after the correction material has been peeled off. The tape 220 used for correction of the necessary paper and from the surface of which the correction material has been peeled off is wound around second roller 240.

The fixing pole 213 for guiding the move of the tape 220 is further installed in the case 210. The third cog wheel 260 rotatably installed in its place while being engaged with the first cog wheel 232 and rotating according to the rotational degree of the first cog wheel 232 is further installed in one side of the inner surface of the case 210. A protrusion 262 protruding upwards, for guiding the movement of the tape 220 having passed through the tape guide 260 is installed on the surface of the upper portion of the third cog wheel 260. The third cog wheel 260 in which the protrusion 262 is formed enables the tape 220 from which the correction material has been peeled off to be wound around the second roller 240 via the tape guide 250, which is an essential portion of the present invention. The third cog wheel 260 can be varied in various forms, which will be described in more detail later. The third cog wheel 260 is always rotated during correction, although the tape 220 from which the correction material is not completely removed contacts the upper surface thereof, or the correction material having a certain adhesive property is stuck to the surface thereof. Thus, the movement of the tape 220 is not prevented due to a frictional resistance.

As shown in FIGS. 3 and 4, during a user's correction work, the first roller 230 rotates counterclockwise. Here, the first cog wheel 232 rotates in the same direction. The second cog wheel 242 and the third cog wheel 260 both which are engaged with the first cog wheel 232 rotate clockwise. Accordingly, the second roller 240 and the protrusion 262 rotate clockwise. As a result, the correction material coated tape 220 is supplied to the tape guide 250 via the fixing pole 213 at the state where the tape 220 is wound around the first roller 230, and thus the correction material is coated on paper by means of the tape guide 250. Then, the correction material removed tape 220 is wound around the second roller 240 via the protrusion 262 of the third cog wheel 260. At this time, the tape 220 is supplied toward the second roller 240 at the state where the correction material is not completely removed, and contacts the protrusion 262. Also, as being the case, it often occurs that the correction material still having an adhesive property adheres to the surface of the protrusion 262.

By the above-described processes, even though the correction material which has not been completely removed from the surface of the tape 220 contacts or is stuck to the surface of the protrusion 262, a frictional resistance due to the correction material is not generated since the protrusion 262 itself rotates. That is, although the tape 220 from which the correction material has not been removed is supplied abruptly to the protrusion 262, the frictional resistance due to the correction material is not generated and the tape supply and take-up is smoothly performed.

As shown, an elongate hole is formed in one side of the case 210, to manually rotate the first roller 230 as necessary and adjust the tension of the tape 220. It is preferable that the case 220 is made of a transparent material.

Figure 5:
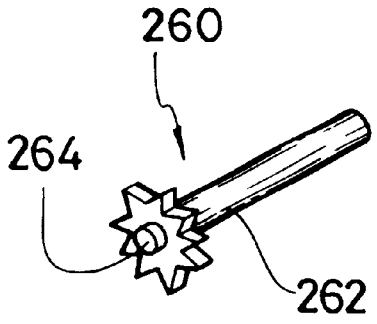
FIG. 5 is a perspective view showing an example of a third cog wheel.
Figure 6:
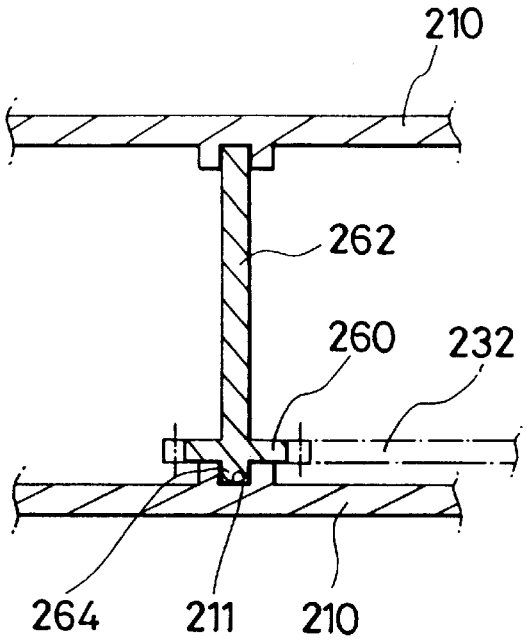
FIG. 6 is a sectional view showing the installation state of the third cog wheel of FIG. 5.

FIG. 5 is a perspective view showing an example of a third cog wheel. FIG. 6 is a sectional view showing the installation state of the third cog wheel of FIG. 5.

As shown in FIG. 5, a protrusion 262 is protrudingly formed upwards at the center of the upper surface of the third cog wheel 260, and a support protrusion 264 which enables to be rotatably installed in the case 210 is formed at the center of the bottom surface thereof. The installation state of the third cog wheel 260 can be seen from FIG. 6. As shown in FIG. 6, a support groove 211 is installed in the inner surface of the case 210, with a result that the third cog wheel 260 is rotatably installed in its place. In this state, the third cog wheel 260 is engaged with the first cog wheel 232.

Figure 7:
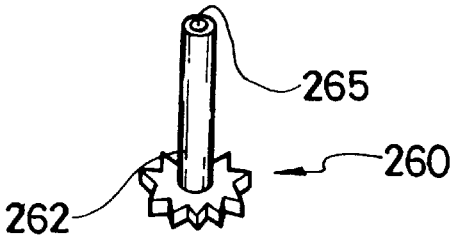
FIG. 7 is a perspective view showing another example of the third cog wheel.
Figure 8:
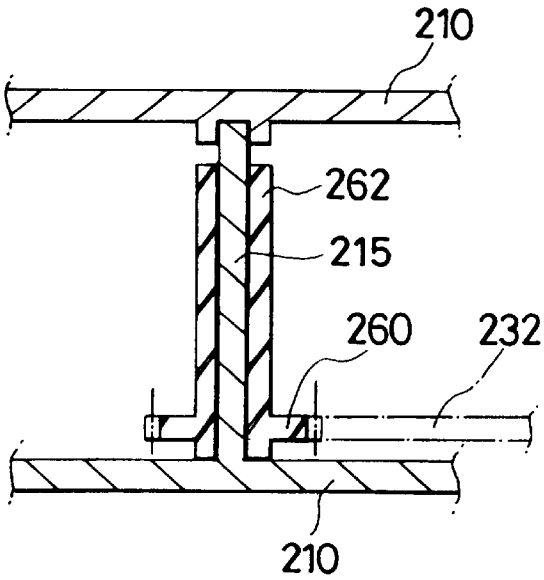
FIG. 8 is a sectional view showing the installation state of the third cog wheel of FIG. 7.

FIG. 7 is a perspective view showing another example of the third cog wheel. FIG. 8 is a sectional view showing the installation state of the third cog wheel of FIG. 7.

As shown in FIG. 7, a protrusion 262 is protrudingly formed upwards at the center of the upper surface of the third cog wheel 260, and a throughhole 265 is formed along the inside of the protrusion 262. In this situation, a support protrusion 215 which is inserted into the throughhole 265 and rotatably supports the third cog wheel 260 in its place is formed. The installation state of the third cog wheel 260 can be seen from FIG. 8. As shown in FIG. 8, a support protrusion 215 is installed in the inner surface of the case 210, with a result that the third cog wheel 260 is rotatably installed in its place. In this state, the third cog wheel 260 is engaged with the first cog wheel 232.

Figure 9:
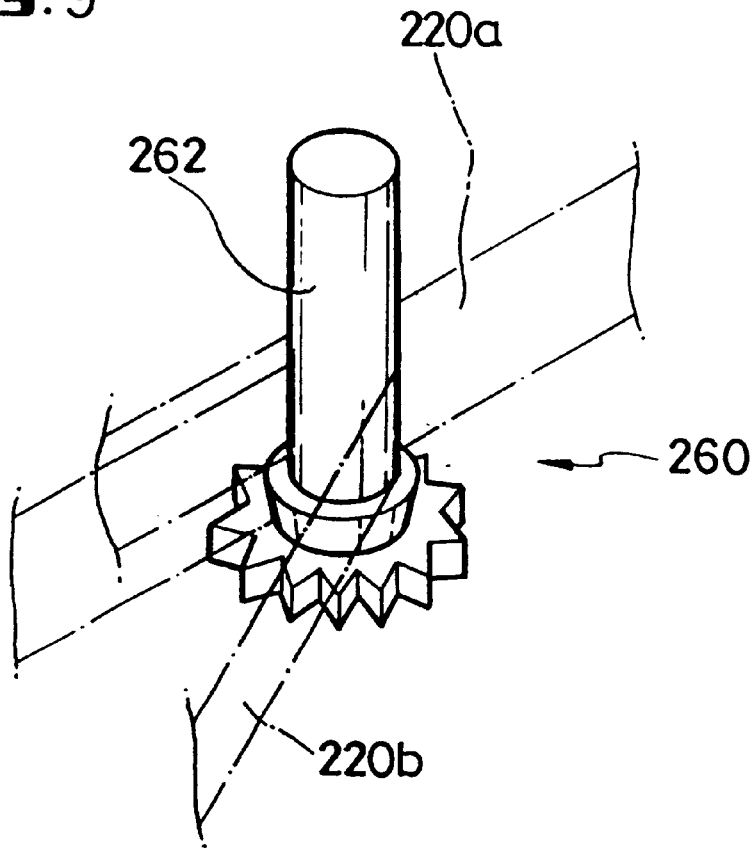
FIG. 9 is a perspective view showing still another example of the third cog wheel.
Figure 10:
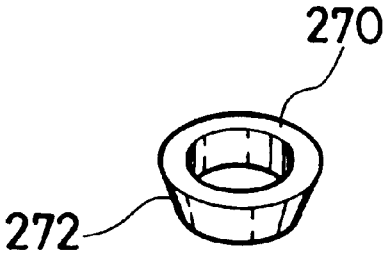
FIG. 10 is an enlarged perspective view of a rotational ring of FIG. 9.
Figure 11:
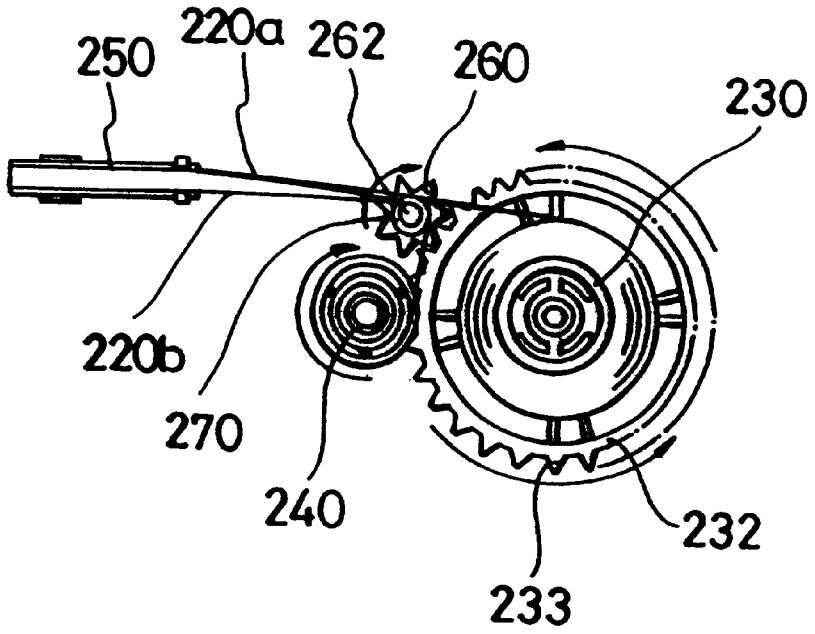
FIG. 11 is a view for explaining the tape movement procedure according to use of the rotational ring.

FIG. 9 is a perspective view showing still another example of the third cog wheel. FIG. 10 is an enlarged perspective view of a rotational ring of FIG. 9. FIG. 11 is a view for explaining the tape movement path according to use of the rotational ring.

As can be seen from FIGS. 9 to 11, as being the case, a rotational ring 270 can be installed on the protrusion 262 of the third cog wheel 260. The rotational ring 270 plays a role in place of the fixing pole 213 formed in the case 210 shown in FIGS. 3 and 4, in order to guide the correction material coated tape 220*a*. That is, in the case that the rotational ring 270 is used, the fixing pole 213 shown in FIGS. 3 and 4 may not be installed. As shown in FIG. 10, it is preferable that the side surface of the rotational ring 270 is formed with a slight slope. However, a slope is not always necessary. In this situation, it is much better that the tape guide 250 is used at the state shown in FIG. 11 which is obtained by rotating the tape guide 250 of FIG. 3 by approximately 90 degrees. Only by doing so, the tape 220*a* supplied toward the tape guide 250 from he first roller 230 is slanted to one side, and can be smoothly guided by a slant surface 272 of the rotational ring 270. That is, as shown in FIGS. 9 and 10, the lower end of the correction material coated ape 220*a* is guided by the rotational ring 270 and supplied toward the tape guide 250, while the correction material removed tape 220*b* is guided by the protrusion 262 positioned in the upper side of the rotational ring 270, and supplied toward the second roller 240. When the rotational ring 270 is employed, the fixing pole 213 installed in the case 210 can be removed. That is, a situation where the case 210 cannot be used due to a broken fixing pole 213 can no longer occur. It is apparent that the rotational ring 20 can be applied to the third cog wheel 260 as shown in FIGS. 7 and 8.

What is claimed is:

1. A correction tape roller device having a case of a predetermined shape including a first roller rotatably installed in the case around which tape coated with a correction material is wound, a second roller located adjacent the first roller, upon which tape released from the first roller is wound and from which the correction material has been peeled off, with the tape passing from the first roller along a predetermined tape movement path, a fixing pole protruding inwardly from the case for guiding the correction material coated tape along the tape movement path, a tape guide protruding outwardly from the case for guiding the correction material coated tape and for allowing said tape to a be pressed over predetermined paper after the correction material is peeled off, wherein the correction tape roller device comprises:

a rotatable first cog wheel connected to the first roller and being rotated in response to a release degree of the tape wound around the first roller;

a rotatable second cog wheel connected to the second roller and engaging with the first cog wheel for rotating in response to the rotation of the first cog wheel so as to cause the tape from which correction material has been peeled off to wind around the first roller; and a rotatable third cog wheel extending inwardly from the case while being engaged to the first cog wheel so as to rotate in response to the rotation of the first cog wheel, with the third cog wheel having a protrusion extending therefrom for guiding the movement of the tape through the tape guide.

2. A correction tape roller device having a case of a predetermined shape including, a first roller rotatably installed in the case around which tape coated with a correction material is wound, a second roller located adjacent the first roller, upon which tape released from the first roller is wound and from which the correction material has been peeled off, with the tape passing from the first roller to the second roller along a predetermined tape movement path and a tape guide protrudingly outwardly from the case for guiding and allowing the correction material coated tape to be pressed over predetermined paper after the correction material is peeled off from the tape, the correction tape roller device comprising:

a rotatable first cog wheel connected to the first roller and being rotated in response to a release degree of the tape wound around the first roller;

a rotatable second cog wheel connected to the second roller and engaging with the first cog wheel for rotation in response to the rotation of the first cog wheel to cause the tape from which the correction material has been peeled off to wind the first roller;

a rotatable third cog wheel extending from the case while being engaged to the first cog wheel so as to rotate in response to the rotation of the first cog wheel, said third cog wheel having a protrusion extending therefrom; and a rotational ring rotatably connected to the protrude at its outer circumferential surface for guiding the correction material coated tape along the tape movement path.

* * * * *